United States Patent [19]

Smith

[11] 4,074,825

[45] Feb. 21, 1978

[54] END CAP ASSEMBLY FOR AN APPLIANCE CONTROL PANEL

[75] Inventor: David G. Smith, Weston, Canada

[73] Assignee: GSW Limited/Limitee, Toronto, Canada

[21] Appl. No.: 742,374

[22] Filed: Nov. 16, 1976

[51] Int. Cl.[2] ..... B65D 7/00; B65D 7/42

[52] U.S. Cl. ..... 220/4 R; 220/66; 220/76

[58] Field of Search ..... 220/4 R, 4 F, 75, 76, 220/80, 306, 307, DIG. 25, 4 C, 14, 63 R, 66, 68, 83

[56] References Cited

U.S. PATENT DOCUMENTS

| | | | |
|---|---|---|---|
| 3,234,318 | 2/1966 | Van Lieshout et al. | 220/306 X |
| 3,692,204 | 9/1972 | Provi et al. | 220/4 F |
| 3,834,579 | 9/1974 | La Croce | 220/66 X |

*Primary Examiner*—Stephen Marcus
*Assistant Examiner*—Steven M. Pollard

[57] ABSTRACT

An end cap assembly for an appliance control panel assembly comprises a sheet metal end cap having attached thereto a molded plastic trim plate. The trim plate has an overturned edge to provide a channel which is adapted to receive and envelop exposed edges of the sheet metal end cap. Means is provided for locating the trim plate on the sheet metal end cap in a manner so as to hold the edges of the metal end cap in the corresponding channels of the trim plate.

6 Claims, 3 Drawing Figures

END CAP ASSEMBLY FOR AN APPLIANCE CONTROL PANEL

FIELD OF INVENTION

This invention relates to an end cap assembly for an appliance control panel assembly and, more particularly, to an end cap assembly which comprises a sheet metal portion having attached thereto a molded plastic trim plate for enveloping edges of the sheet metal.

BACKGROUND OF THE INVENTION

Control panel assemblies or arrangements of one type or another are commonly found on appliances for housing the various appliance controlling devices and which present control dials, timers, clocks, etc. to the user. In the past, it was customary to form by a press operation, the entire control panel of the control cabinet. However, this approach to manufacture has changed over the years to the provision of a control panel assembly having end caps attached to its ends to complete the assembly. The end caps are usually formed from a die-cast metal which requires substantial labour input to finish the casting to an acceptable degree for exterior use on the appliances. As an example, extensive use is now made of a zinc casting which requires buffing to provide a surface on which a smooth chrome plating can be achieved. A further consideration is that the end caps must be free of any metal barbs or the like which can catch clothing or cut the appliance user, to meet the requirements of consumer regulatory bodies. Therefore all edges on the end caps must be finished to a smooth catch-free surface.

It is therefore an object of the invention to provide a two-component end cap assembly which is less expensive to manufacture, requires less labour input to provide a finished product, and is readily installed on appliance control panel assembly.

It is another object of the invention to provide an end cap assembly made of inexpensive sheet metal having attached thereto a trim plate to cover all exposed edges of the sheet metal and thereby protect the appliance user. The trim plate has means molded thereon to facilitate location and attachment of control panel components to the end cap assembly.

It is a further object of the invention to provide an end cap assembly wherein the trim plate is provided with an overturned edge to receive and envelop exposed edges of the sheet metal end cap where means is provided to locate the trim plate on the end cap in a manner so as to hold the edges of the sheet metal end cap in the channel.

It is yet another object of the invention to provide an end cap assembly which is of such a structural arrangement that the sheet metal end cap provides the structural integrity for the molded plastic trim plate to preclude the trim plate from warping when the end cap assembly is installed on an appliance control panel, particularly on heat generating appliances.

It is yet a further object of the invention to provide an end cap assembly wherein the molded plastic trim plate is made of a material which may be readily chrome-plated.

SUMMARY OF THE INVENTION

This invention provides an end cap assembly using inexpensive sheet metal having attached thereto a molded plastic trim plate which has a channel means for covering all exposed edges on the sheet metal end cap. All the advantages of a molded article are obtained from the use of such a trim plate in that various types of means may be molded on the trim plate to facilitate attachment of control panel parts to the trim plate and also to facilitate location of such parts on the end cap assembly. The plastic trim plate is located on the sheet metal end cap by a means which ensures that the exposed edges of the sheet metal end cap are held in a channel portion of the trim plate during installation of the end cap assembly on an appliance control panel. The channel portion covers any edges of the sheet metal in a manner to preclude catching of clothing or cutting the appliance user's hand.

The end cap assembly according to the invention comprises a sheet metal end cap having attached thereto a molded plastic trim plate. The sheet metal end cap has an outer and an inner surface and at least one exposed edge. The trim plate has a broad planar portion overlying the inner surface of the sheet metal end cap along the at least one edge. The trim plate is molded with an overturned edge along the edge of the trim plate corresponding to the at least one edge of the sheet metal end cap to provide a channel adapted to receive and envelop the at least one edge. Means is provided for locating the trim plate on the sheet metal end cap in a manner so as to hold the at least one edge in the channel.

When the end cap assembly is installed on an appliance control panel assembly, the engagement of the channel of the trim plate with the at least one edge of the sheet metal end cap precludes warping of the molded plastic trim plate.

The inner surface of the molded trim plate may be provided with various types of means to facilitate location and attachment of domestic appliance control panel parts on the end cap assembly. As mentioned, all the advantages of a molded component are obtained without the substantial cost of a zinc casting or the like, where the sheet metal end cap provides the structural integrity for the plastic trim plate.

DESCRIPTION OF THE DRAWINGS

The aforementioned and other objects, advantages and features of the invention will become apparent in the following detailed description of the preferred embodiments of the invention, as shown in the drawings, wherein.

DETAILED DESCRIPTION OF THE PREFERRED EMBODIMENTS

Figure 1:
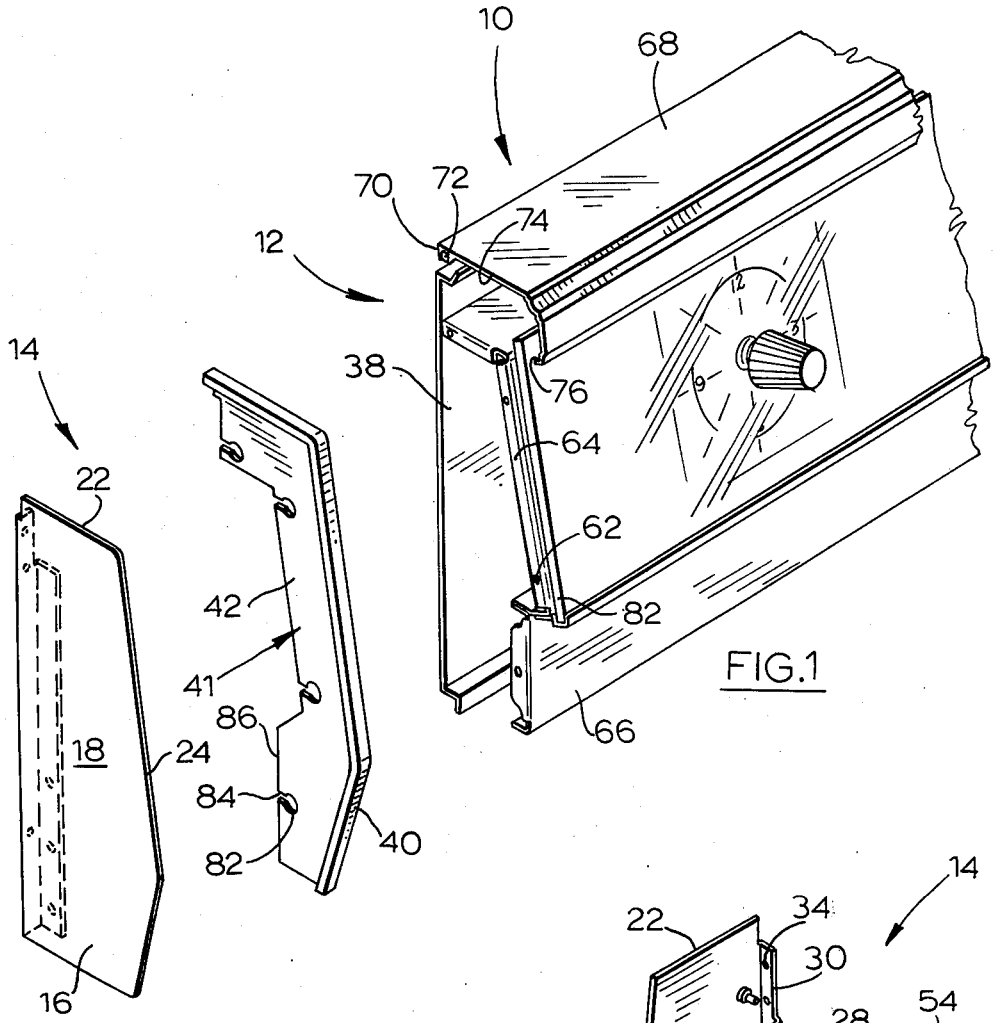
FIG. 1 is an exploded view of an end cap assembly according to the invention to be attached to an open end of an appliance control panel assembly.

The end cap assembly according to this invention may be used on various types of appliance control panels assemblies such as those found on stoves, clothes washing and drying machines, dishwashers, built-in ovens and cook tops, and smaller appliances such as toast-and-bake table top units, electric hand mixers, etc. Referring to FIG. 1, a control panel portion for a stove is shown. The control panel 10 has an open end 12 which is covered by the end cap assembly, generally designated 14.

Figure 2:
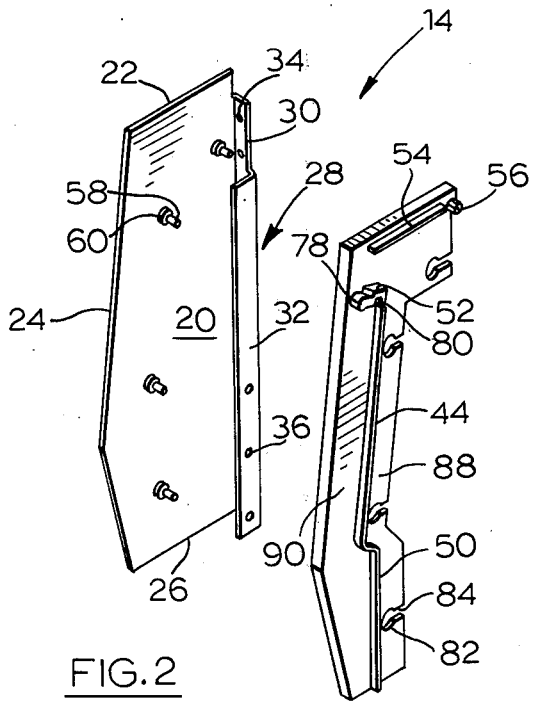
FIG. 2 is another exploded view of the end cap assembly from the other side of that of FIG. 1.

As shown in FIGS. 1 and 2, the end cap assembly 14 comprises a sheet metal end cap 16 having outer and inner surfaces 18 and 20. Considering the mounting of the control panel 10 on an appliance, there is exposed top edge 22 and front edge 24. The bottom edge 26 and remaining back portion generally designated 28, are not exposed to the user of the appliance. The back portion 28 has planar portion 30 with an overlapping inner portion 32. Apertures 34 and 36 are provided in the back edge 28 for purposes of connecting back plate 38 and other internal parts of the control panel 10 to the end cap 16. The sheet metal of the end cap may be preferably 20-gauge sheet steel; however, it is understood that other thicknesses of metal may be used.

Figure 3:
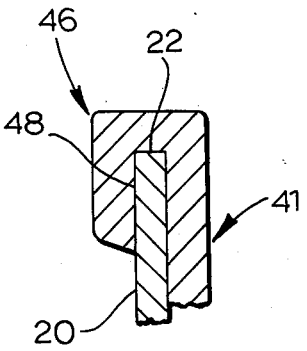
FIG. 3 is a partial section of an edge of a sheet metal end cap with the overturned edge of a trim plate enveloping such edge.

The plastic trim plate 40 has a broad somewhat L-shaped planar portion 41 with an inner surface 42 and an outer surface 44. The broad planar portion 41 is molded with an overturned edge 46 as more clearly shown in FIG. 3 to provide a channel 48 adapted to receive edges 22 or 24. The trim plate may be molded from various types of substantially rigid plastic such as acrylonitrilebutadiene-styrene, "Noryl" (trademark of General Electric) and other suitable plastics. These plastics, when not chrome plated, are preferably made to be flame resistant. Further, when such an end cap assembly is used on a stove or other heat-generating appliance, it is preferable to mold the trim plate from a plastic which has minimum heat distortion properties.

The outer surface 44 of the broad planar portion 41 is provided with a ridge 50, lug 52, ledge 54 and protruding pin 56. Such means are molded on the outer surface 44 to facilitate location of, and attachment of, control panel parts and possibly electrical components on the end cap assembly 14 when it is installed on the control panel 10.

On the interior surface 20 of the sheet metal end cap, four pins 58 which have enlarged head portions 60, are secured by spot welding to the metal end cap. These pins 58 are located so as to be in register with the apertures 62 provided in control panel parts 64 and 66 which on a stove, are commonly referred to as the front panel cresting and the back splash panel. The pins 58 are provided with a threading portion which may accept speed nuts, self-threading nuts, threaded nuts or the like to secure the sheet metal end cap to the control panel components with the trim plate 40 sandwiched between the sheet metal end cap 16 and the control panel components 64 and 66.

The lid 68 of the control panel may be pivoted about its back portion 70 by groove 72 cooperating with pin 56 of each trim plate. Ledge 54 supports the edge portion 74 of the lid 66 when the lid is closed and the front downwardly depending lip 76 engages the rounded forward lug portion 78 to provide a snap-closing of the lid 68. The inner portion of lug 52 may be provided with a recess 80 to receive the glass overlay edge 82. The panel components 64 and 66 are positioned behind the ridge 50 of the trim plate with the glass overlay positioned in front of the ridge 50 to provide a finished end cap assembly for the control panel unit.

The broad planar portion 40 is provided with four apertures 82 which are in register with pins 58. Slots 84 communicate with apertures 82 and extend outwardly from apertures 82 in a direction away from channel 48 to the periphery 86 of the broad planar portion 41. To assemble the trim plate on the sheet metal end cap 16, the trim plate is slid over the end cap with the inner surface 42 angled relative to the inner surface 20 of the end cap, the slots 84 engaging the pins to guide the sliding movement of the trim plate. As the trim plate is slid into position, the edges 22 and 24 are positioned in the channel 48. With the trim plate in assembled position, the inner surface 42 contacts the inner surface 20 of the end cap. The enlarged pin head portions 60 engage the apertures 82. The size of each aperture 82 is slightly greater than the size of the pin head 60 where the slots 84 are smaller than the apertures 82 but greater than the width of the pins 58. The engagement between the periphery of each aperture 82 and the respective pin head 60 prevents removal of the trim plate from the end cap as long as the broad planar portion lies against the end cap. This particular arrangement therefore provides a means for locating or positioning the edges 22 and 24 of the sheet metal plate 16 in the channel 48. The enlarged pin heads 60 permits the use of aperatures 82 which are substantially wider than pins 58 to facilitate insertions of the pins into the apertures while the edges 22 and 24 are received by channel 48.

With the interference fit between the pin heads 60 and the apertures 82, the trim plate is held in position during installation of the end cap on the control panel 10. The rearward portion 88 of the broad planar portion behind the ridge 50 is sandwiched between the control panel components 64 and 66 to locate and retain the edges 22 and 24 in the channel 48. The thickness of the pin head 60 may be preferably the same as the thickness of the broad planar portion in the area 88 around each aperture so that upon assembly of the end cap on the control panel 19, the heads 60 abut the panel components to prevent drawing the pins too far into the control panel components to cause dimples or depressions on the exterior finished surface of the end cap 16.

The slots 84, in acting as guidance means in locating the trim plate on the end cap, may be of various configurations and designs depending upon the shape of the end cap so as to guide the trim plate in a manner to locate the edges of the end cap in the channel of the trim plate in an easy manner. It is understood, of course, that in an embodiment of the invention the trim plate can be assembled without the slots 84 because the larger sized apertures 82 permit manipulation of the trim plate in a manner to locate the edge 22 and 24 in the channel and then press the broad planar portion down onto the end cap to locate the pin head 60 in the apertures 82.

It is understood that other arrangements may be used as means for positioning the sheet metal end cap edges in the channel of the trim plate. Examples of other arrangements include the use of adhesives, clips secured to the metal end cap for engaging the broad planar portion of the trim plate and the like.

With regard to the installation of an end cap assembly on a stove or other heat-generating appliances, it is necessary to ensure that the trim plate 40 does not warp to cause an unpleasing appearance. As previously discussed, the overturned edge portion 46 of the trim plate engages the edges 22 and 24 so that the metal end cap 16 provides a structural backbone for the molded plastic trim plate 40 to prevent its warping. Further, after assembly the trim plate is sandwiched between the control panel parts and the end cap 16 to further ensure that warping the trim plate is precluded. Therefore, an advantage is gained in providing a trim plate which encloses the edges 22 and 24 of the sheet metal end cap to protect the consumer from cuts and caught clothing and at the same time, this engagement of the overturned edge of the trim plate with the sheet metal edges assists in precluding warping of the plastic trim plate Although various preferred embodiments of the invention have been described herein in detail, it will be understood by those skilled in the art that variations may be made thereto without departing from the spirit of the invention or the scope of the appended claim.

The embodiments of the invention in which an exclusive property or privilege is claimed are defined as follows:

1. An end cap assembly for an appliance control panel assembly comprising a sheet metal end cap having attached thereto a molded plastic trim plate, said sheet metal end cap having an outer and inner surface and at least one edge, said trim plate having a broad planar portion overlying the inner surface of said sheet metal end cap adjacent to and along the length of said at least one edge, said trim plate being molded at its periphery with an overturned edge along the edge of the trim plate corresponding to the at least one edge of the sheet metal end cap to provide a channel adapted to receive and envelop said at least one edge and a plurality of spaced apart pins having enlarged head portions secured to the inner surface of said sheet metal end cap for holding said trim plate on said sheet metal end cap in a manner so as to position said at least one edge in said channel, said broad planar portion of the trim plate being provided with a plurality of apertures in register with said plurality of pins, the size of each aperture being slightly greater than the size of a corresponding pin head portion, the periphery of the apertures engaging the pin head portions to hold the at least one edge of said sheet metal end cap in said channel when said trim plate is attached.

2. An end cap assembly of claim 1 wherein the engagement of said channel with said at least one edge of the sheet metal end cap precludes warping of said trim plate when said end cap assembly is installed on an appliance control panel.

3. An end cap assembly of claim 1 wherein said broad planar portion of the trim plate is provided with means to facilitate location and attachment of appliance control panel parts on said end cap assembly.

4. An end cap assembly of claim 1 wherein a plurality of slots are provided in said broad planar portion, each slot being in communication with a respective aperture and extending from the aperture to the trim plate's periphery in a direction away from said channel, the width of the slot being less than the width of the aperture and greater than the width of said pin.

5. An end cap assembly of claim 1 wherein the thickness of said pin head is approximately the same as the thickness of said broad planar portion in the area around said aperture.

6. An end cap assembly of claim 1 wherein each of said pins has a threading portion to facilitate securing of said end cap assembly to an appliance control panel assembly.

* * * * *